US007698863B2

(12) United States Patent
Forsland et al.

(10) Patent No.: US 7,698,863 B2
(45) Date of Patent: Apr. 20, 2010

(54) WINDOW ASSEMBLY AND METHODS

(75) Inventors: H. Kent Forsland, River Falls, WI (US); Jack A. Reichert, Prescott, WI (US); Dean A. Benoy, River Falls, WI (US)

(73) Assignee: Designer Doors, Inc., River Falls, WI (US)

( * ) Notice: Subject to any disclaimer, the term of this patent is extended or adjusted under 35 U.S.C. 154(b) by 1220 days.

(21) Appl. No.: 11/192,555

(22) Filed: Jul. 28, 2005

(65) Prior Publication Data

US 2007/0022698 A1 Feb. 1, 2007

(51) Int. Cl.
*E06B 3/68* (2006.01)
*E06B 3/96* (2006.01)

(52) U.S. Cl. ..... 52/456; 52/204.61; 52/745.15

(58) Field of Classification Search ..... 52/204.61, 52/204.54, 204.59, 204.53, 314, 456, 666, 52/205, 204.1, 656.5
See application file for complete search history.

(56) References Cited

U.S. PATENT DOCUMENTS 954,003 A * 4/1910 Perkins ..... 52/456
4,122,633 A * 10/1978 Holdiman ..... 49/501
5,123,211 A * 6/1992 Schlicht et al. ..... 52/202
6,035,597 A * 3/2000 Donaldson ..... 52/456

* cited by examiner

*Primary Examiner*—Robert J Canfield
(74) *Attorney, Agent, or Firm*—Merchant & Gould P.C.

(57) ABSTRACT

A window assembly includes first, second, third, and fourth frame pieces connected together to form a rectangular frame. Each of the frame pieces has an inside face defining a glass-receiving groove and a muntin-engaging face orthogonal to the inside face and defining a muntin-receiving channel. A first muntin is oriented in the first frame piece muntin-receiving channel and the second frame piece muntin-receiving channel, and a second muntin is oriented in the third frame piece muntin-receiving channel and the fourth frame piece muntin-receiving channel. The first and second muntins cross over to engage at a first half lap joint. The frame pieces are connected to each other with rabbet joints. The window assembly can be part of a garage door arrangement. A method of making a window assembly includes connecting together the frame pieces with rabbet joints and orienting first and second muntins to engage at a lap joint. Methods of retrofitting existing windowless garage doors to include windows includes cutting a hole in the garage door and dropping a window assembly into the hole. The window assembly can then be removably secured to the garage door with fasteners.

14 Claims, 4 Drawing Sheets

WINDOW ASSEMBLY AND METHODS

TECHNICAL FIELD

This application relates to windows. In particular, this application relates to windows, methods of assembly, and mounting of windows, especially for garage doors.

BACKGROUND

Windows are used to provide exterior light into otherwise enclosed buildings. Windows are also used to enhance the attractiveness of enclosed buildings. They can also help to prevent criminal activity by allowing for the activities within an enclosed building to be visible from the exterior through the window.

Windows on garage doors are useful for all of these reasons. There is a need for an inexpensive, quick-assembled window that can be used in, for example, garage doors.

SUMMARY

A window assembly is provided including a plurality of frame pieces connected together to form a rectangular frame. The frame pieces are configured with appropriately provided grooves and channels to allow for a quickly-assembled window.

In one embodiment, the window assembly has first, second, third, and fourth frame pieces. Each of the frame pieces has first and second opposite ends, an inside face, and a muntin-engaging face. The inside face defines a glass-receiving groove therein. The muntin-engaging face is orthogonal to the inside face and defines a muntin-receiving channel. The frame pieces are connected together to form a rectangular frame. The frame pieces are connected together by rabbet joints, such that the glass-receiving groove of each frame piece is in communication with an adjacent glass-receiving groove. A first muntin is oriented in muntin-receiving channels of the frame pieces, and a second muntin is oriented in muntin-receiving channels of the frame pieces, such that the first and second muntins cross over to engage at a first half lap joint.

In another aspect, a garage door is provided. The garage door includes a door to selectively allow and prevent access to a garage interior. The door has at least one window assembly. The window assembly can be a type of window assembly as characterized above.

In another aspect, a method of making a window assembly is provided. The method includes providing first, second, third, and fourth frame pieces, each of the frame pieces having first and second opposite ends, an inside face, and a muntin-engaging face. The inside face defines a glass-receiving groove therein. The muntin-engaging face is orthogonal to the inside face and defines a muntin-receiving channel. The method includes connecting the first frame piece first end to the third frame piece first end with a rabbet joint. The first frame piece glass-receiving groove is arranged to be in communication with the third frame piece glass-receiving groove. The method includes connecting the first frame piece second end to the fourth frame piece first end with a rabbet joint, so that the first frame piece glass-receiving groove is in communication with the fourth frame piece glass-receiving groove. The method also includes orienting a first muntin in at least the first frame piece muntin-receiving channel. The method also includes orienting a second muntin in at least the third frame piece muntin-receiving channel to engage against the first muntin at a first half lap joint.

DETAILED DESCRIPTION

Figure 1:
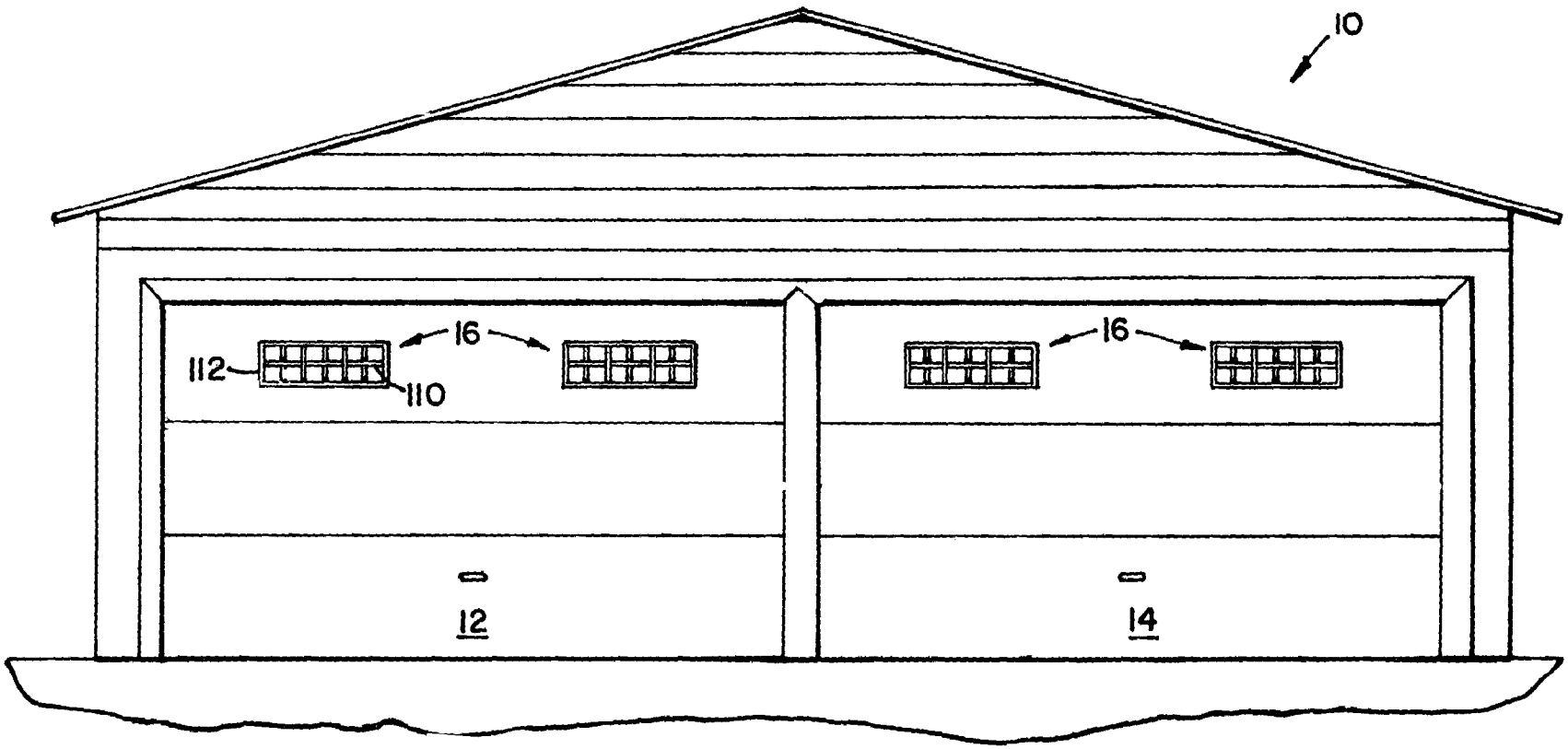
FIG. 1 is a front elevational view of a garage door having window assemblies made in accordance with principles of this disclosure.

Reference is made to FIG. 1. FIG. 1 illustrates a front elevational view of a garage 10 having a pair of garage doors 12, 14. Each garage door 12, 14 can be mounted (e.g., rolling in tracks or the like) to selectively allow and prevent access to an interior in the garage 10 and is generally sized large enough to permit passage of a motor vehicle in and out of the garage 10. As can be seen in FIG. 1, each door 12, 14 has a plurality of window assemblies 16. The window assemblies 16 allow for light transmittal into the garage interior, enhance the attractiveness of the garage 10, and can prevent crime by allowing visibility into the garage interior from the outside.

Figure 2:
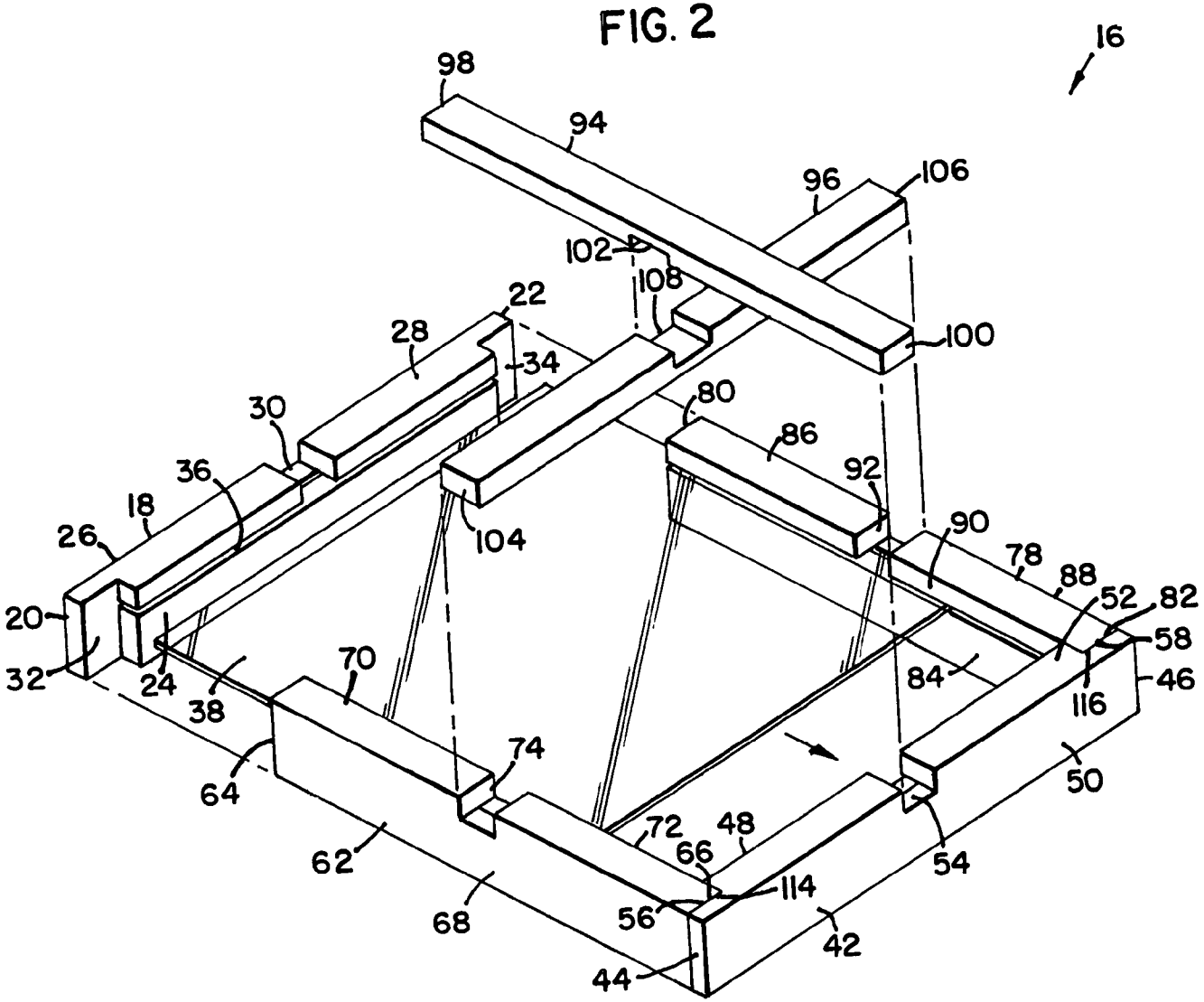
FIG. 2 is an exploded, perspective view of a first embodiment of a window assembly made in accordance with principles of this disclosure.

FIG. 2 illustrates one embodiment of window assembly 16. The window assembly 16 illustrated in FIG. 2 is shown in an exploded, perspective view and is one example only. The window assembly 16 shown in FIG. 2 differs from the example window assemblies 16 shown in FIG. 1 only in dimension and in the number of muntins. The principles explained regarding the window assembly 16 in FIG. 2 can be applied to make windows of varying dimensions and number of muntins, as will be apparent to those skilled in the art.

In the embodiment of FIG. 2, the window assembly 16 includes a first frame piece 18. The first frame piece 18 is preferably a single-piece member or construction having a first end 20 and an opposite, second end 22. The first frame piece 18 has an inside face 24, an opposite outside face 26, and a muntin-engaging face 28 extending between the inside face 24 and outside face 26. As such, the muntin-engaging face 28 is generally orthogonal to the inside face 24 and to the outside face 26. As can be seen in FIG. 2, the muntin-engaging face 28 defines at least one notch or muntin-receiving channel 30. In the embodiment shown, the muntin-receiving channel 30 is centered between the first end 20 and second end 22. In other embodiments, the muntin-receiving channel 30 can be off to one side or the other. Only a single muntin-receiving channel 30 is illustrated, and in other embodiments there can be multiple muntin-receiving channels 30 defined by the muntin-engaging face 28. The muntin-receiving channel 30 is illustrated as having a generally rectangular cross-section, which matches the cross-section of muntins, described further below.

Still in reference to FIG. 2, the first frame piece 18 includes a first notch 32 at the first frame piece first end 20. Similarly, there is a second notch 34 at the first frame piece second end 22. The notches 32, 34 cooperate with other frame pieces to form a rabbet joint, explained further below.

The inside face 24 of the first frame piece 18 defines a glass-receiving groove 36 therein. The glass-receiving groove 36 has a width and a depth sufficient to hold a typical pane of glass, such as a regular double strength glass or an insulated glass. Such a glass has a thickness of 0.5 inch or less. A pane of glass 38 can be seen in the exploded window assembly 16.

Still in reference to FIG. 2, the window assembly 16 further includes a second frame piece 42. In the preferred embodiment, the second frame piece 42 is constructed identically as the first frame piece 18. As such, the second frame piece 42 includes a first end 44, an opposite second end 46, an inside face 48, an outside face 50, and a muntin-engaging face 52. The muntin-engaging face 52 defines a muntin-receiving channel 54 arranged to be coaxial with the muntin-receiving channel 30 of the first frame piece 18. The inside face 48 includes a glass-receiving groove, identical to the one shown at reference numeral 36 for the first frame piece 18. The second frame piece 42 also includes a first notch 56 at the first end 44, and a second notch 58 at the second end 46.

The window assembly 16 further includes a third frame piece 62. The third frame piece 62 has a first end 64 and an opposite second end 66. The third frame piece 62 also has an outside face 68 and a muntin-engaging face 70 generally orthogonal to the outside face 68. Orthogonal to the muntin-engaging face 70 and opposite of the outside face 68 is an inside face 72. The inside face 72 has a glass-receiving groove identical to the groove shown at 36 for the first frame piece 18. The muntin-engaging face 70 defines a muntin-receiving channel 74 therein. In the embodiment shown, the muntin-receiving channel 74 is centered between the first end 64 and the second end 66. In the embodiment shown, the muntin-receiving channel 74 has a rectangular cross-section, generally matching a cross-section of muntins, described further below.

The first end 64 and second end 66 of the third frame piece 62 differs from the ends of the first frame piece 18 and second frame piece 42. While the first and second frame pieces 18, 42 have notches 32, 34, 56, 58, the third frame piece 62 has flat, flush ends 64, 66. These ends 64, 66 cooperate with the ends of the first frame piece 18 and second frame piece 42 to form rabbet joints, as described further below.

The window assembly 16 further includes a fourth frame piece 78. The fourth frame piece 78 is preferably identical to the third frame piece 62. As such, the fourth frame piece 78 includes first and second flat, flush ends 80, 82, an inside face 84, a muntin-engaging face 86, and an outside face 88. The inside face 84 defines a glass-receiving groove 90 extending between the first end 80 and the second end 82. A muntin-engaging face 86 defines a muntin-receiving channel 92, which in the embodiment shown, is centered between the first end 80 and second end 82. In the embodiment shown, the muntin-receiving channel 92 is coaxial with the muntin-receiving channel 74 of the third frame piece 62. The third frame piece 62 has a glass-receiving groove that is identical to the glass-receiving groove 90. The first, second, third, and fourth frame pieces 18, 42, 62, 78 cooperate to form a frame 112. In the embodiment shown, the frame 112 is rectangular.

Also shown in the embodiment of FIG. 2 is a first muntin 94 and a second muntin 96. Although only two muntins 94, 96 are illustrated, it should be understood that more muntins or fewer or no muntins can be used in the window assembly 16. The muntins 94, 96 provide the appearance of dividing the glass pane 38 into smaller regions. In this embodiment, the first and second muntins 94, 96 provide the appearance of four different sections of glass pane 38. This can be seen in FIG. 1.

The first and second muntins 94, 96 are preferably constructed identically to each other. The first muntin 94 has a first end 98 and an opposite second end 100. Centered between the first end 98 and the second end 100 is a muntin-receiving channel 102. Again, in other embodiments, the muntin-receiving channel 102 can be at a location other than centered between the first end 98 and the second end 100.

The second muntin 96 has a first end 104 and an opposite second end 106. In the embodiment shown, centered between the first end 104 and the second end 106 is a muntin-receiving channel 108. After assembly, the muntin-receiving channel 102 of the first muntin 94 engages the muntin-receiving channel 108 of the second muntin 96 to engage at a first half lap joint 110 (FIG. 1). The half lap joint 110 is formed by an intersection or crossing over of the first muntin 94 and second muntin 96 such that there is a generally continuous, smooth intersection at the joint 110.

As mentioned above, the first frame piece 18, second frame piece 42, third frame piece 62, and fourth frame piece 78 are connected together to form a rectangular frame 112 (FIG. 1). The rectangular frame 112 can be a square, in some embodiments. The first frame piece first end 20 is connected to the third frame piece first end 64 by a rabbet joint. The rabbet joint is formed by the flush first end 64 engaging or being received by the first notch 32, and the first frame piece glass-receiving groove 36 being in communication with the third frame piece glass-receiving groove (the one identical to the groove 90). By the term "in communication", it is meant that the groove is continuous such that the pane of glass 38 can be received within the groove without interruptions.

The first frame piece second end 22 is connected to the fourth frame piece first end 80 by a rabbet joint. Again, the flush first end 80 is received within the notch 34 of the first frame piece 18. The glass-receiving groove 36 of the first frame piece 18 is in communication with the fourth frame piece glass receiving groove 90.

The second frame piece first end 44 is connected to the third frame piece second end 66 by a rabbet joint 114. The rabbet joint 114 is formed by the flush second end 66 being received by the first notch 56 in the second frame piece 42. The glass-receiving groove of the second frame piece 42 is in communication with the glass-receiving groove of the third frame piece 62.

The second frame piece second end 46 is connected to the fourth frame piece second end 82 by a rabbet joint 116. In particular, the second end 82 is received by the second notch 58 of the second frame piece 42. The glass-receiving groove 90 is in communication with the glass-receiving groove of the second frame piece 42.

The window assembly 16 is formed so that the pane of glass 38 is received by and installed within the glass receiving groove of each of the frame pieces 18, 42, 62, 78. The first and second muntins 94, 96 are placed over the glass 38. In particular, the first muntin 94 is oriented in the first frame piece muntin-receiving channel 30 and the second frame piece muntin-receiving channel 54. The second muntin 96 is oriented in the third frame piece muntin-receiving channel 74 and in the fourth frame piece muntin-receiving channel 92.

Figure 4:
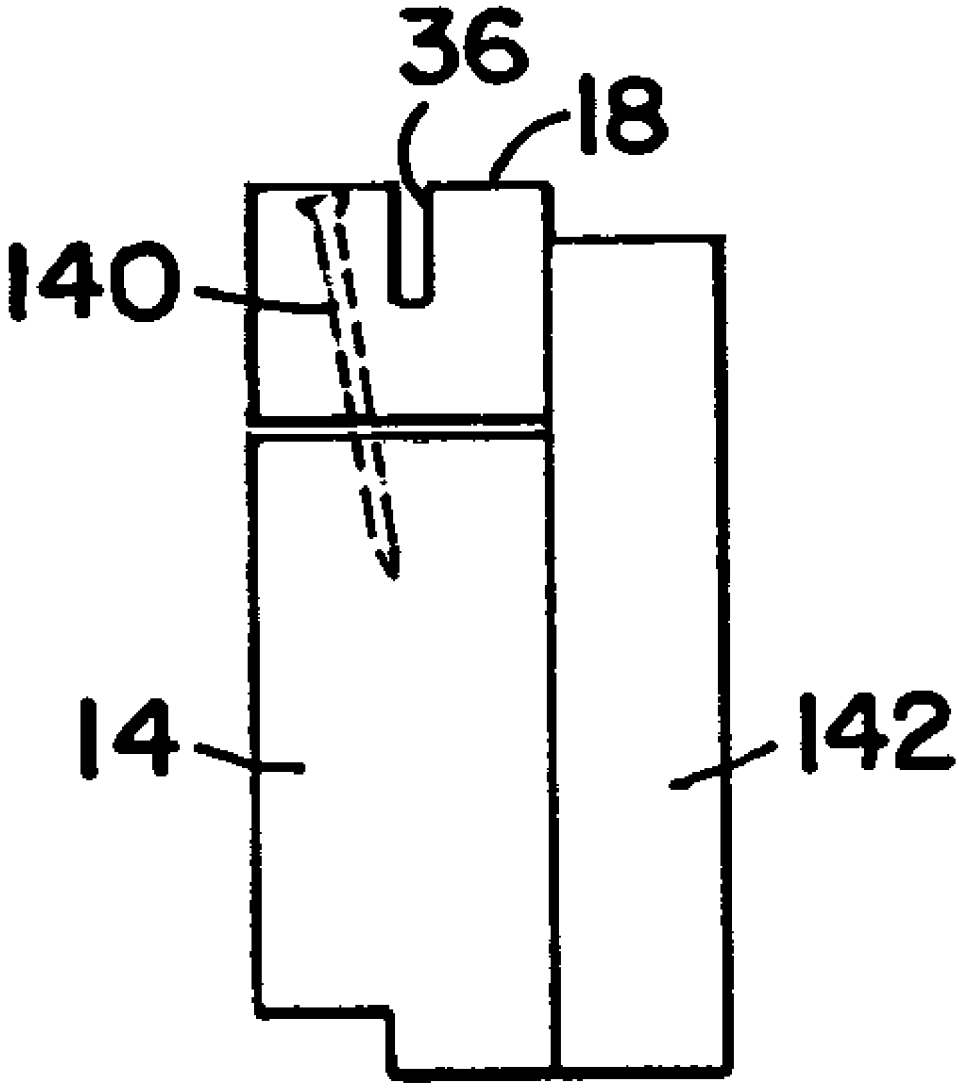
FIG. 4 is a schematic view of a portion of a window assembly attached to a garage door, in accordance with principles of this disclosure.

The window assembly 16 is then complete and can be mounted in the garage door 12, 14. Typically, the garage door 12, 14 has a hole cut into it, and the window assembly 16 is mounted in the hole and secured to the door 12, 14 by, for example, screwing the frame pieces 18, 42, 62, 78 to the door 12, 14 with screws 140 (FIG. 4). The window assembly 16 is oriented on the garage door 12, 14 such that the pane of glass 38 faces the exterior, while the first and second muntins 94, 96 are oriented towards the interior of the garage 10. FIG. 4 illustrates the frame piece 18 secured to garage 12, 14 with the screw 140. Also illustrated in FIG. 4 is trim or an overlay 142 mounted over the door 12, 14 for decorative purposes. Although the frame piece 18 is the one illustrated, it should be understood that each of the frame pieces are mounted to the door 12, 14 with, in the example shown, screw 140. The use of screws 140 allows the window assembly 16 to be easily removable from the door 12, 14, in case glass 38 in the window assembly 16 needs replacement. The screws 140 allow for selective mounting and dismounting of the window assembly 16 into and out of the garage door 12, 14.

The window assembly 16 can be used to retrofit a pre-existing garage door that did not already have windows (a "windowless" garage door). To retrofit an existing garage door that does not have windows, holes are cut into the garage door sized to receive the desired shaped window assembly 16. If desired, the garage door has an overlay mounted over the door for decorative purposes. The overlay can be boards, such as western red cedar boards that are nailed to the garage door. The overlay is mounted on the garage door such that it does not cover the exposed holes for receiving the window assembly 16. After the holes are cut into the door, the window assembly 16 is dropped in so that it is received by the hole. If an overlay was provided, the window assembly 16 is dropped in or placed in the hole from the side without the overlay and pressed flush against the overlay. The window assembly 16 is then secured to the garage door using, for example, screws 140 to allow for selective removal of the assembly 16 in case, for example, the glass 38 breaks.

Figure 3:
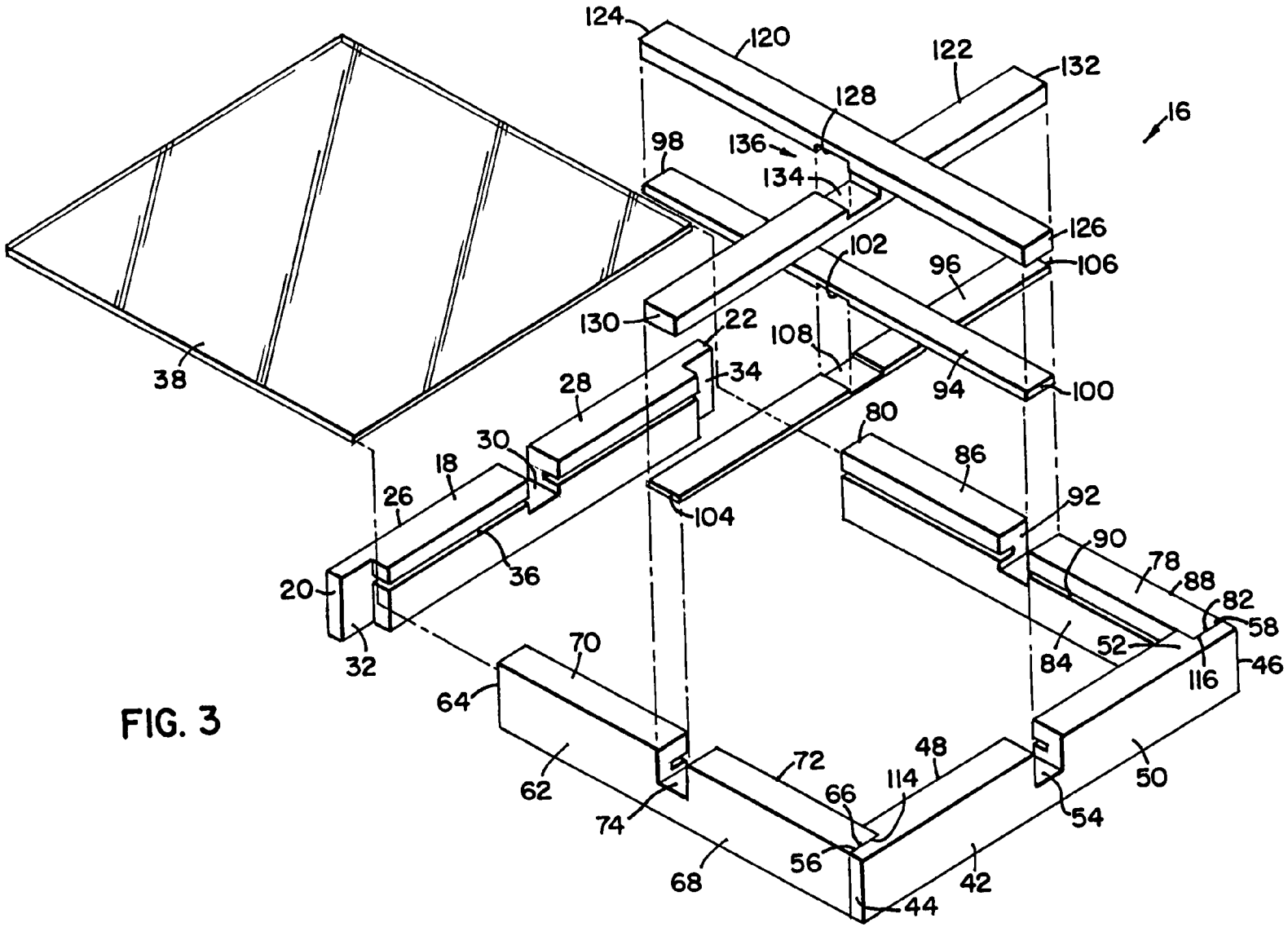
FIG. 3 is an exploded, perspective view of a second embodiment of a window assembly made in accordance with principles of this disclosure.

A second embodiment is shown in FIG. 3 at 16'. The window assembly 16' is identical to the window assembly 16, except for the addition of third and fourth muntins 120, 122. The other structure is identical to the first embodiment, so the same reference numerals are used.

The third muntin 120 includes a first end 124 and an opposite second end 126. Centered between the first and second ends 124, 126 is a muntin-receiving channel 128.

The fourth muntin 122 includes a first end 130 and a second end 132. Centered between the first and second ends 130, 132 is a muntin-receiving channel 134.

The third muntin 120 is oriented in the first frame piece muntin-receiving channel 30 and the second frame piece muntin-receiving channel 54. Preferably, the glass pane 38 is oriented such that it is between the third muntin 120 and the first muntin 94.

The fourth muntin 122 is oriented in the third frame piece muntin-receiving channel 74 and in the fourth frame piece muntin-receiving channel 92. The glass pane 38 is between the fourth muntin 122 and the muntin 96. The third muntin 120 and the fourth muntin 122 cross over to engage at a second half lap joint 136. In the particular, the muntin-receiving channel 128 engages the muntin-receiving channel 134 so that when the third and fourth muntins 120, 122 are connected together in an overlapping fashion, the intersection is smooth and continuous. In preferred embodiments, the third muntin 120 is identical to the fourth muntin 122.

A method of making a window assembly is provided. The method includes providing first, second, third, and fourth frame pieces, such as the frame pieces 18, 42, 62, and 78 described above. The first frame piece first end 20 is connected to the third frame piece first end 64 with a rabbet joint. This is done such that the glass-receiving groove of each frame piece is in communication to be a continuous groove. The first frame piece second end 22 is connected to the fourth frame piece first end 80 with a rabbet joint. Again, the glass-receiving grooves are aligned to be in communication with each other and to be continuous. There is a step of orienting a first muntin 94 in at least the first frame piece muntin-receiving channel 30 and orienting a second muntin 96 in at least the third frame piece muntin-receiving channel 74 to engage against the first muntin 94 at the first half lap joint 110.

The method further includes a step of inserting a pane of glass, such as glass 38, into the glass-receiving grooves of the first frame piece 18, third frame piece 62, and fourth frame piece 78.

The method also includes connecting the second frame piece second end 46 to the third frame piece second end 66 with a rabbet joint. Again, the glass-receiving grooves are aligned to be in communication with each other. Next, the second frame piece second end 46 is connected to the fourth frame piece second end 82 with a rabbet joint. The glass-receiving grooves are aligned to be in communication.

In one embodiment, after the steps of orienting first and second muntins 94, 96, there is the step of inserting a pane of glass 38 into the glass-receiving grooves of the first frame piece 18, third frame piece 62, and fourth frame piece 78. After this step, a third muntin 120 is oriented in at least the first frame piece muntin-receiving channel 30 over the pane of glass 38, and a fourth muntin 122 is oriented in at least the third frame piece muntin-receiving channel 74 to engage against the third muntin 120 at a second half lap joint. In this embodiment, there is further the step of connecting the second frame piece first end 44 to the third frame piece second end 66 with a rabbet joint, the glass-receiving grooves being in communication. Further, the second frame piece second end 46 is connected to the fourth frame piece second end 82 with a rabbet joint, and the glass-receiving grooves are in communication with each other.

The assembled windows 16, 16' can then be mounted in the garage doors 12, 14. Of course, the window assemblies 16, 16' can be used in structures other than garage doors.

The window assemblies 16, 16' can be made from a variety of materials, and are preferably wood, in particular, cedar. In other embodiments, the windows 16, 16' can be made from plastic or metallic pieces, or composites.

The window assemblies 16, 16' can be built to custom size. Typical sizes include the frame pieces being made from pieces of wood two inches in width and one inch in thickness. The dimension of each window can typically be many different sizes, for example one foot by one foot, and larger.

What is claimed is:

1. A window assembly comprising:

(a) first, second, third, and fourth frame pieces; each of the first, second, third, and fourth frame pieces having first and second opposite ends, an inside face, and a muntin-engaging face;

(i) the inside face defining a glass-receiving groove therein;

(ii) the muntin-engaging face being orthogonal to the inside face and defining a muntin-receiving channel, wherein the muntin-engaging faces of each of the first, second, third, and fourth frame pieces are oriented on the same side of the glass-receiving grooves;

(b) the first, second, third, and fourth frame pieces being connected together to form a rectangular frame;

(i) the first frame piece first end being connected to the third frame piece first end by a rabbet joint; the first frame piece glass-receiving groove being in communication with the third frame piece glass-receiving groove;

(ii) the first frame piece second end being connected to the fourth frame piece first end by a rabbet joint; the first frame piece glass-receiving groove being in communication with the fourth frame piece glass-receiving groove;

(iii) the second frame piece first end being connected to the third frame piece second end by a rabbet joint; the second frame piece glass-receiving groove being in communication with the third frame piece glass-receiving groove;

(iv) the second frame piece second end being connected to the fourth frame piece second end by a rabbet joint; the second frame piece glass-receiving groove being in communication with the fourth frame piece glass-receiving groove;

(c) a first muntin oriented in the first frame piece muntin-receiving channel and the second frame piece muntin-receiving channel; and (d) a second muntin oriented in the third frame piece muntin-receiving channel and the fourth frame piece muntin-receiving channel;

(i) the first and second muntin crossing over to engage at a first half lap joint;

(e) a glass pane oriented in the window assembly and received by the first frame piece glass-receiving groove, the second frame piece glass-receiving groove, the third frame piece glass-receiving groove and the fourth frame piece glass-receiving groove;

(f) a third muntin oriented in the first frame piece muntin-receiving channel and the second frame piece muntin-receiving channel;

(i) the glass pane being between the third muntin and the first muntin; and (g) a fourth muntin oriented in the third frame piece muntin-receiving channel and the fourth frame piece muntin-receiving channel;

(i) the glass pane being between the fourth muntin and the second muntin;

(ii) the third and fourth muntin crossing over to engage at a second half lap joint.

2. A window assembly according to claim 1 wherein:

(a) the first frame piece and the second frame piece are identical;

(b) the third frame piece and the fourth frame piece are identical;

(c) the first frame piece has a first notch at the first frame piece first end and a second notch at the first frame piece second end;

(d) the second frame piece has a third notch at the second frame piece first end and a fourth notch at the second frame piece second end;

(e) the third frame piece first end rests in the first notch, and the third frame piece second end rests in the third notch;

(f) the fourth frame piece first end rests in the second notch, and the fourth frame piece second end rest in the fourth notch;

(g) the first frame piece muntin-receiving channel is centered between the first frame piece first and second ends;

(h) the second frame piece muntin-receiving channel is centered between the second frame piece first and second ends;

(i) the third frame piece muntin-receiving channel is centered between the third frame piece first and second ends; and (j) the fourth frame piece muntin-receiving channel is centered between the fourth frame piece first and second ends.

3. A window assembly according to claim 1 wherein:

(a) the first frame piece and the second frame piece are identical; and (b) the third frame piece and the fourth frame piece are identical.

4. A window assembly according to claim 3 wherein:

(a) the first frame piece has a first notch at the first frame piece first end and a second notch at the first frame piece second end;

(b) the second frame piece has a third notch at the second frame piece first end and a fourth notch at the second frame piece second end;

(c) the third frame piece first end rests in the first notch, and the third frame piece second end rests in the third notch; and (d) the fourth frame piece first end rests in the second notch, and the fourth frame piece second end rest in the fourth notch.

5. A window assembly according to claim 1 wherein:

(a) the first frame piece muntin-receiving channel is centered between the first frame piece first and second ends;

(b) the second frame piece muntin-receiving channel is centered between the second frame piece first and second ends;

(c) the third frame piece muntin-receiving channel is centered between the third frame piece first and second ends; and (d) the fourth frame piece muntin-receiving channel is centered between the fourth frame piece first and second ends.

6. A garage door arrangement comprising:

(a) a garage door to selectively allow and prevent access to a garage interior; the door having at least one window assembly including:

(i) first, second, third, and fourth frame pieces; each of the first, second, third, and fourth frame pieces having first and second opposite ends, an inside face, and a muntin-engaging face;

(A) the inside face defining a glass-receiving groove therein;

(B) the muntin-engaging face being orthogonal to the inside face and defining a muntin-receiving channel, wherein the muntin-engaging faces of each of the first, second, third, and fourth frame pieces are oriented on the same side of the glass-receiving grooves;

(ii) the first, second, third, and fourth frame pieces being connected together to form a rectangular frame;

(A) the first frame piece first end being connected to the third frame piece first end by a rabbet joint; the first frame piece glass-receiving groove being in communication with the third frame piece glass-receiving groove;

(B) the first frame piece second end being connected to the fourth frame piece first end by a rabbet joint; the first frame piece glass-receiving groove being in communication with the fourth frame piece glass-receiving groove;

(C) the second frame piece first end being connected to the third frame piece second end by a rabbet joint; the second frame piece glass-receiving groove being in communication with the third frame piece glass-receiving groove;

(D) the second frame piece second end being connected to the fourth frame piece second end by a rabbet joint; the second frame piece glass-receiving groove being in communication with the fourth frame piece glass-receiving groove;

(iii) a first muntin oriented in the first frame piece muntin-receiving channel and the second frame piece muntin-receiving channel; and (iv) a second muntin oriented in the third frame piece muntin-receiving channel and the fourth frame piece muntin-receiving channel;

(A) the first and second muntin crossing over to engage at a first half lap joint;

wherein the window assembly further comprises a glass pane oriented in the window assembly and received by the first frame piece glass-receiving groove, the second frame piece glass-receiving groove, the third frame piece glass-receiving groove, and the fourth frame piece glass-receiving groove;

(v) a third muntin oriented in the first frame piece muntin-receiving channel and the second frame piece muntin-receiving channel; the glass pane being between the third muntin and the first muntin; and (vi) a fourth muntin oriented in the third frame piece muntin-receiving channel and the fourth frame piece muntin-receiving channel; the glass pane being between the fourth muntin and the second muntin; the third and fourth muntin crossing over to engage at a second half lap joint.

7. A garage door arrangement according to claim 6 wherein:

(a) the garage door has a plurality of window assemblies therein.

8. A garage door arrangement according to claim 7 further comprising a plurality of screws mounted between the first, second, third, and fourth frame pieces and the garage door to provide selective mounting and dismounting of the at least one window assembly and the garage door.

9. A window assembly comprising:

(a) first, second, third, and fourth frame pieces; each of the first, second, third, and fourth frame pieces having first and second opposite ends, an inside face, and a muntin-engaging face;

(i) the inside face defining a glass-receiving groove therein;

(ii) the muntin-engaging face being orthogonal to the inside face and defining a muntin-receiving channel;

(b) the first, second, third, and fourth frame pieces being connected together to form a rectangular frame;

(i) the first frame piece first end being connected to the third frame piece first end by a rabbet joint; the first frame piece glass-receiving groove being in communication with the third frame piece glass-receiving groove;

(ii) the first frame piece second end being connected to the fourth frame piece first end by a rabbet joint; the first frame piece glass-receiving groove being in communication with the fourth frame piece glass-receiving groove;

(iii) the second frame piece first end being connected to the third frame piece second end by a rabbet joint; the second frame piece glass-receiving groove being in communication with the third frame piece glass-receiving groove;

(iv) the second frame piece second end being connected to the fourth frame piece second end by a rabbet joint; the second frame piece glass-receiving groove being in communication with the fourth frame piece glass-receiving groove;

(c) a first muntin oriented in the first frame piece muntin-receiving channel and the second frame piece muntin-receiving channel; and (d) a second muntin oriented in the third frame piece muntin-receiving channel and the fourth frame piece muntin-receiving channel;

(i) the first and second muntins crossing over to engage at a first half lap joint;

(e) a glass pane oriented in the window assembly and received by the first frame piece glass-receiving groove, the second frame piece glass-receiving groove, the third frame piece glass-receiving groove, and the fourth frame piece glass-receiving groove;

(f) a third muntin oriented in the first frame piece muntin-receiving channel and the second frame piece muntin-receiving channel;

(i) the glass pane being between the third muntin and the first muntin; and (g) a fourth muntin oriented in the third frame piece muntin-receiving channel and the fourth frame piece muntin-receiving channel;

(i) the glass pane being between the fourth muntin and the second muntin;

(ii) the third and fourth muntin crossing over to engage at a second half lap joint.

10. A garage door arrangement comprising:

(a) a garage door to selectively allow and prevent access to a garage interior; the door having at least one window assembly including:

(i) first, second, third, and fourth frame pieces; each of the first, second, third, and fourth frame pieces having first and second opposite ends, an inside face, and a muntin-engaging face;

(A) the inside face defining a glass-receiving groove therein;

(B) the muntin-engaging face being orthogonal to the inside face and defining a muntin-receiving channel;

(ii) the first, second, third, and fourth frame pieces being connected together to form a rectangular frame;

(A) the first frame piece first end being connected to the third frame piece first end by a rabbet joint; the first frame piece glass-receiving groove being in communication with the third frame piece glass-receiving groove;

(B) the first frame piece second end being connected to the fourth frame piece first end by a rabbet joint; the first frame piece glass-receiving groove being in communication with the fourth frame piece glass-receiving groove;

(C) the second frame piece first end being connected to the third frame piece second end by a rabbet joint; the second frame piece glass-receiving groove being in communication with the third frame piece glass-receiving groove;

(D) the second frame piece second end being connected to the fourth frame piece second end by a rabbet joint; the second frame piece glass-receiving groove being in communication with the fourth frame piece glass-receiving groove;

(iii) a first muntin oriented in the first frame piece muntin-receiving channel and the second frame piece muntin-receiving channel;

(iv) a second muntin oriented in the third frame piece muntin-receiving channel and the fourth frame piece muntin-receiving channel;

(A) the first and second muntins crossing over to engage at a first half lap joint;

(v) a glass pane oriented in the window assembly and received by the first frame piece glass-receiving groove, the second frame piece glass-receiving groove, the third frame piece glass-receiving groove, and the fourth frame piece glass-receiving groove;

(vi) a third muntin oriented in the first frame piece muntin-receiving channel and the second frame piece muntin-receiving channel;

(A) the glass pane being between the third muntin and the first muntin; and (vii) a fourth muntin oriented in the third frame piece muntin-receiving channel and the fourth frame piece muntin-receiving channel;

(A) the glass pane being between the fourth muntin and the second muntin;

(B) the third and fourth muntins crossing over to engage at a second half lap joint.

11. A method of making a window assembly; the method comprising:

(a) providing first, second, third, and fourth frame pieces; each of the first, second, third, and fourth frame pieces having first and second opposite ends, an inside face, and a muntin-engaging face;

(i) the inside face defining a glass-receiving groove therein;

(ii) the muntin-engaging face being orthogonal to the inside face and defining a muntin-receiving channel;

(b) connecting the first frame piece first end to the third frame piece first end with a rabbet joint; the first frame piece glass-receiving groove being in communication with the third frame piece glass-receiving groove;

(c) connecting the first frame piece second end to the fourth frame piece first end with a rabbet joint; the first frame piece glass-receiving groove being in communication with the fourth frame piece glass-receiving groove;

(d) orienting a first muntin in at least the first frame piece muntin-receiving channel;

(e) orienting a second muntin in at least the third frame piece muntin-receiving channel to engage against the first muntin at a first half lap joint;

(f) after the steps of orienting a first muntin and a second muntin, inserting a pane of glass into the glass-receiving grooves of the first frame piece, third frame piece, and fourth frame piece; and (g) after the step of inserting a pane of glass into the glass-receiving grooves of the first frame piece, third frame piece, and fourth frame piece, orienting a third muntin in at least the first frame piece muntin-receiving channel over the pane of glass and orienting a fourth muntin in at least the third frame piece muntin-receiving channel to engage against the third muntin at a second half lap joint.

12. A method according to claim 11 further comprising:

inserting a pane of glass into the glass-receiving grooves of the first frame piece, third frame piece, and fourth frame piece.

13. A method according to claim 12 further comprising:

(a) connecting the second frame piece first end to the third frame piece second end with a rabbet joint; the second frame piece glass-receiving groove being in communication with the third frame piece glass-receiving groove; and (b) connecting the second frame piece second end to the fourth frame piece second end with a rabbet joint; the second frame piece glass-receiving groove being in communication with the fourth frame piece glass-receiving groove.

14. A method according to claim 11 further comprising:

(a) connecting the second frame piece first end to the third frame piece second end with a rabbet joint; the second frame piece glass-receiving groove being in communication with the third frame piece glass-receiving groove; and (b) connecting the second frame piece second end to the fourth frame piece second end with a rabbet joint; the second frame piece glass-receiving groove being in communication with the fourth frame piece glass-receiving groove.

* * * * *